US005575691A

United States Patent [19]

Matthews

[11] Patent Number: 5,575,691

[45] Date of Patent: Nov. 19, 1996

[54] APPARATUS FOR FRONT OR REAR EXTRACTION OF AN ELECTRICAL CONTACT FROM A CONNECTOR HOUSING

[75] Inventor: Russell H. Matthews, Modesto, Calif.

[73] Assignee: Elcon Products International, Fremont, Calif.

[21] Appl. No.: 435,814

[22] Filed: May 5, 1995

[51] Int. Cl.[6] ..... H01R 13/426

[52] U.S. Cl. ..... 439/744

[58] Field of Search ..... 439/744, 745

[56] References Cited

U.S. PATENT DOCUMENTS

| | | | |
|---|---|---|---|
| 3,054,078 | 9/1962 | Baschkin | 339/18 |
| 3,120,989 | 2/1964 | Solorow et al. | 339/256 |
| 3,205,295 | 9/1965 | Davidson | 174/32 |
| 3,246,281 | 4/1966 | Cunningham | 439/744 |
| 3,287,517 | 11/1966 | Campbell | 200/50 |
| 3,375,481 | 3/1968 | Parnell | 339/94 |
| 3,383,643 | 5/1968 | Nava et al. | 339/205 |
| 3,456,231 | 7/1969 | Paullus et al. | 339/60 |
| 3,471,822 | 10/1969 | Van Baelen | 339/18 |
| 3,475,720 | 10/1969 | Culver | 439/744 |
| 3,478,305 | 11/1969 | Chirumbolo | 439/744 |
| 3,560,911 | 2/1971 | Zimmerman, Jr. et al. | 339/258 |
| 3,587,029 | 6/1971 | Knowles | 339/14 |
| 3,597,726 | 8/1971 | Appleton et al. | 339/198 |
| 3,617,992 | 11/1971 | Ruehlemann et al. | 339/242 |
| 3,697,933 | 10/1972 | Black et al. | 339/192 R |
| 3,697,935 | 10/1972 | Drapkin | 439/744 |
| 3,783,321 | 1/1974 | Patterson | 317/101 R |
| 3,808,578 | 4/1974 | Hansen | 339/59 M |
| 3,835,442 | 9/1974 | Anderson et al. | 339/59 R |
| 4,090,764 | 5/1978 | Malsby et al. | 339/103 M |
| 4,333,703 | 6/1982 | Anhalt et al. | 439/745 |
| 4,514,784 | 4/1985 | Williams et al. | 361/386 |
| 4,653,842 | 3/1987 | Kirma | 339/198 P |
| 4,728,163 | 3/1988 | Kittinger et al. | 439/172 |
| 4,749,357 | 6/1988 | Foley | 439/80 |
| 4,753,616 | 6/1988 | Molitor | 439/787 |
| 4,776,816 | 10/1988 | Herscovici et al. | 439/744 |
| 4,824,380 | 4/1989 | Matthews | 439/78 |
| 4,846,737 | 7/1989 | Jorroch et al. | 439/752 |
| 4,854,899 | 8/1989 | Matthews | 439/724 |
| 4,867,713 | 9/1989 | Ozu et al. | 439/833 |
| 4,902,235 | 2/1990 | Tonooka | 439/72 |
| 5,055,055 | 10/1991 | Bakker | 439/78 |
| 5,088,942 | 2/1992 | Welsh et al. | 439/843 |
| 5,124,883 | 6/1992 | Bakker | 361/386 |
| 5,211,589 | 5/1993 | McCardell | 439/879 |
| 5,261,840 | 11/1993 | Benz | 439/843 |
| 5,306,182 | 4/1994 | Fukushima et al. | 439/857 |
| 5,342,226 | 8/1994 | Hayes et al. | 439/845 |

FOREIGN PATENT DOCUMENTS

| | | |
|---|---|---|
| 0549960A2 | 7/1993 | European Pat. Off. . |
| 2479581 | 2/1981 | France . |
| 2158187 | 6/1972 | Germany . |

OTHER PUBLICATIONS

Astro Tool Corp. catalog, pp. 12–14.

*Primary Examiner*—Gary F. Paumen

*Attorney, Agent, or Firm*—Burns, Doane, Swecker & Mathis, L.L.P.

[57] ABSTRACT

A universally releasable and extractable retention clip for an electrical contact in a connector housing, the retention clip includes at least one arcuate element having a first end and a second end, and a retaining mechanism located between the first end and the second end which engages a first face and a second face of a collar around the electrical contact for removably retaining the electrical contact in the clip. The arcuate element is resiliently biased such that when the arcuate element is contacted near either its first end or second end with a release and extraction tool, the retaining mechanism is disengaged from both the first face and the second face of the collar simultaneously so that the electrical contact can be extracted from the front or rear of the connector housing.

15 Claims, 13 Drawing Sheets

APPARATUS FOR FRONT OR REAR EXTRACTION OF AN ELECTRICAL CONTACT FROM A CONNECTOR HOUSING

FIELD OF THE INVENTION

The present invention relates generally to electrical connectors and particularly to retention clips for retaining electrical contacts in a connector housing. More particularly, the retention clip of the present invention allows for an electrical contact to be extracted from the front or the back of the connector housing regardless of whether the contact is released from the front or the back of the connector housing, thus providing a universally releasable and extractable retention clip.

BACKGROUND OF THE INVENTION

Electrical connectors are used in pluggable, including hot-pluggable, power supply applications. The standard range of connectors offers wide versatility of power distribution circuitry, allowing AC power into and DC power out of a power supply for current up to 200 amps in a compact housing. The connector plan form, or contact layout, can be made compatible with the requirements for minimizing the noise properties of power supplies including those for switched mode power supplies. Electrical contacts are layed-out within a connector housing. These electrical contacts are known by many names including but not limited to inserts, conductive contacts, and conductive pins. Available contacts include crimp, solder and printed circuit board tail for direct backplane mounting. Rack and panel connector systems are available for use in applications ranging from the very high power requirements of UPS systems to high pin count connectors required for ATE. Rack and panel systems can be used in any electrical or electronic product where currents are high, reliability a must and low power losses essential. Typical applications include: data processing terminals, computer main frames, telecommunications equipment, switching equipment, UPS systems, automatic test equipment, burn-in systems, and power supplies.

In the electrical connector industry, there have been insertable and removable (i.e., extractable) contacts around for quite some time. These contacts are broken down into rear release and front release. The front is defined as that portion of the connector where the pin projects or the entry to the socket access resides. Up until now in both the rear release and the front release contacts, removal of the contact/wire is from the rear of the connector housing only. Accessibility to the rear of the connector housing is a hinderance, and replacing or redressing wires is a problem. For the rear extraction only contacts, the equipment box containing the connector housing has to be opened up, and often times the connector housing removed from the box in order to replace or redress wires or contacts.

FIGS. 10 and 11 are typical examples of a rear release/rear extraction retention clips of the prior art. Retention clip 500 is generally cylindrical in shape with barbs 502 projecting inwardly. Barbs 502 are biased inward such that when pin contact 27 is inserted through opening 504 in the back of the connector housing 26. The barbs are pushed aside by collar 33 until the pin contact is fully inserted into the connector housing then barbs 502 return to their inward position and engage surface 50 of collar 33.

This type of retention clip is known as rear release/rear extraction because a rear release/rear extraction tool 506 is slid over wire 508 from the rear of the connector housing after the equipment box (not shown) that houses the connector housing 26 has been removed. Tool 506 is pushed into opening 504 toward surface 50. As forward annular edge 510 comes in contact with barbs 502, it pushes the barbs back toward cavity inner surface 512 just as collar 33 did when pin contact 27 was inserted into the housing. Tool 506 is inserted until annular edge 510 abuts surface 50. Tool 506 holds the barbs free from collar 33 as pin contact 27, tool 506 and wire 508 are removed through opening 504 in the rear of connector housing 26.

However, in panel mounted connectors located at the back of an enclosure where equipment such as a power supply may be installed on a track, only front access is available to the connector housing, therefore it would be desirable to have a front release/front extractable retention clip.

SUMMARY OF THE INVENTION

One purpose of the present invention is to provide a retention clip for a socket contact or pin contact that is front releasable/front extractable. Another purpose of the present invention is to provide a retention clip that is front or rear releasable/rear extractable. A third purpose of the present invention is to provide a retention clip that is front or rear releasable/front extractable. A fourth purpose is to provide a universally releasable/extractable retention clip.

To accomplish these purposes, there is provided a retention dement having a unique configuration which is arcuate in one embodiment and hour-glass shaped in another embodiment. Both embodiments operate in the same manner. Along the arcuate or hour-glass shaped retention clip, there is a set of tabs spaced along the retention clip from one another such that they can receive a portion of an electrical contact in the gap between them. The retention clip, although arcuate, is flexible. Therefore, when an electrical contact release tool is inserted into the retention clip, the arcuate element deflects away from the electrical contact and as a result the tabs move away from the electrical contact together and allow the electrical contact to be removed (i.e., extracted) from the front or the rear of the connector housing.

In accordance with one embodiment of the present invention, there is provided a retaining clip for receiving a collar on an electrical contact, the collar having a first face and a second face, the clip comprising at least one arcuate element having a first end and a second end, and a retaining means located between the first end and the second end engaging the first face and second face of the collar for removably retaining the electrical contact in the clip, the arcuate element being resiliently biased such that when the arcuate element is contacted near the first end, the retaining means is disengaged from both the first face and the second face.

In accordance with another embodiment, there is provided a connector comprising a housing having at least one receptacle, at least one retaining element in the receptacle having a first end and a second end, and a retaining means located between the first end and the second end for receiving a collar on an electrical contact, the retaining means engaging a first face and a second face of the collar for removably retaining the electrical contact in the housing, the retaining element is bowed away from a wall of the receptacle and is resiliently biased such that when the retaining element is deflected near its first end toward the wall of the receptacle the retaining means is disengaged from both the first face and the second face.

In accordance with yet another embodiment, there is provided a connector comprising a housing having a plurality of passages, and at least one retention insert in each of the passages having a cantilevered spring element extending from a partial cylindrical base of the retention insert, the cantilevered spring element having a first end, a second end and a retaining means located between the first end and the second end for receiving a collar on an electrical contact, the retaining means engaging a first shoulder and a second shoulder of the collar for removably retaining the electrical contact in the housing, the cantilevered spring element is resiliently biased away from a wall of the passage such that when the cantilevered spring element is deflected near its first end toward the wall of the passage, the retaining means is moved away from both the first shoulder and the second shoulder.

DEFINITIONS

RETENTION CLIP—refers to an element that engages a pin contact or socket contact in order to retain the contact in a connector housing. The retention clip is also known as a retaining element, retention insert, retaining clip, as well as by many other terms.

FRONT RELEASABLE—refers to a retention clip that can be disengaged from a pin contact or socket contact by inserting a tool through an opening in the front of the connector housing containing the retention clip.

REAR RELEASABLE—refers to a retention clip that can be disengaged from a pin contact or socket contact by inserting a tool through the opening in the rear of the connector housing containing the retention clip.

FRONT EXTRACTABLE—refers to a retention clip that allows a pin contact or socket contact to be removed (i.e., extracted) through the opening in the front of the connector housing after the pin contact or socket contact has been released (i.e., disengaged) from the retention clip.

REAR EXTRACTABLE—refers to a retention clip that allows a pin contact or socket contact to be removed (i.e., extracted) through the opening in the rear of the connector housing after the pin contact or socket contact has been released (i.e., disengaged) from the retention clip.

FRONT RELEASABLE/FRONT EXTRACTABLE—refers to a retention clip that allows the performance of both the front releasable and front extractable characteristics defined above.

FRONT RELEASABLE/REAR EXTRACTABLE—refers to a retention clip that allows the performance of both the front releasable and rear extractable characteristics defined above.

REAR RELEASABLE/FRONT EXTRACTABLE—refers to a retention clip that allows the performance of both the rear releasable and front extractable characteristics defined above.

REAR RELEASABLE/REAR EXTRACTABLE—refers to a retention clip that allows the performance of both the rear releasable and rear extractable characteristics defined above.

UNIVERSALLY RELEASABLE/EXTRACTABLE—refers to a retention clip that allows the performance of all of the releasable and extractable characteristics defined above.

BRIEF DESCRIPTION OF THE DRAWING

Many objects and advantages of the present invention will be apparent to those of ordinary skill in the art when this specification is read in conjunction with the attached drawings wherein like reference numerals are applied to like elements and wherein.

DETAILED DESCRIPTION OF THE PREFERRED EMBODIMENTS

Figure 2B:
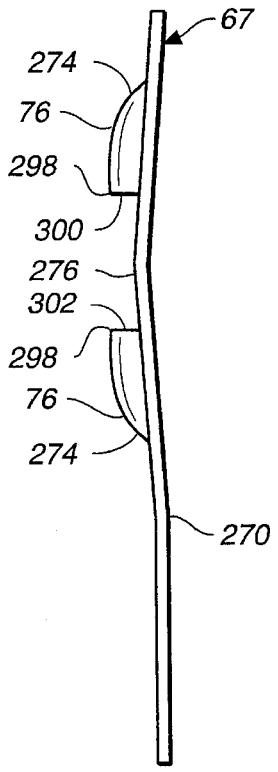
FIG. 2B is a right side elevational view of the retention clip of FIG. 2A.
Figure 3:
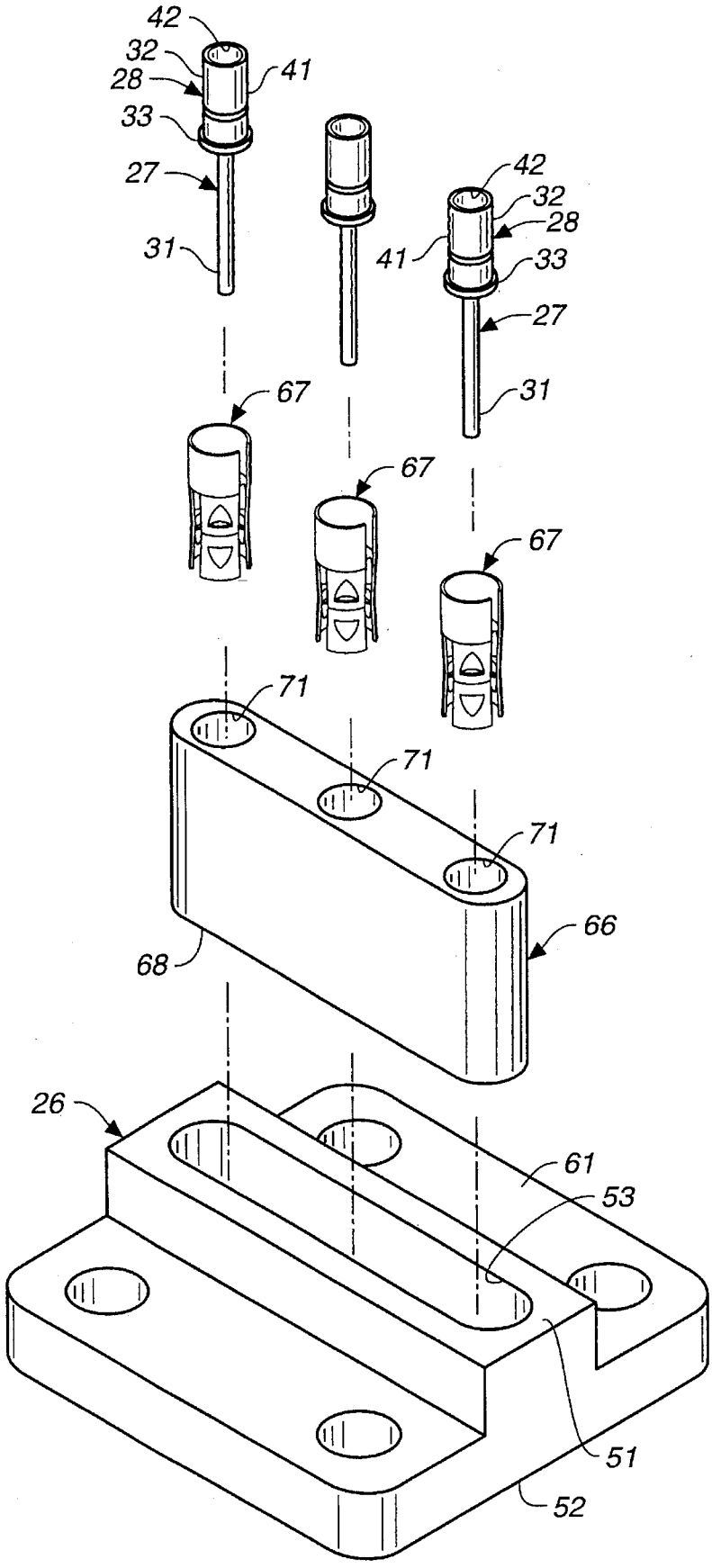
FIG. 3 is an exploded isometric view of a male connector housing with its attendant pin contacts in accordance with one embodiment of the present invention.
Figure 4:
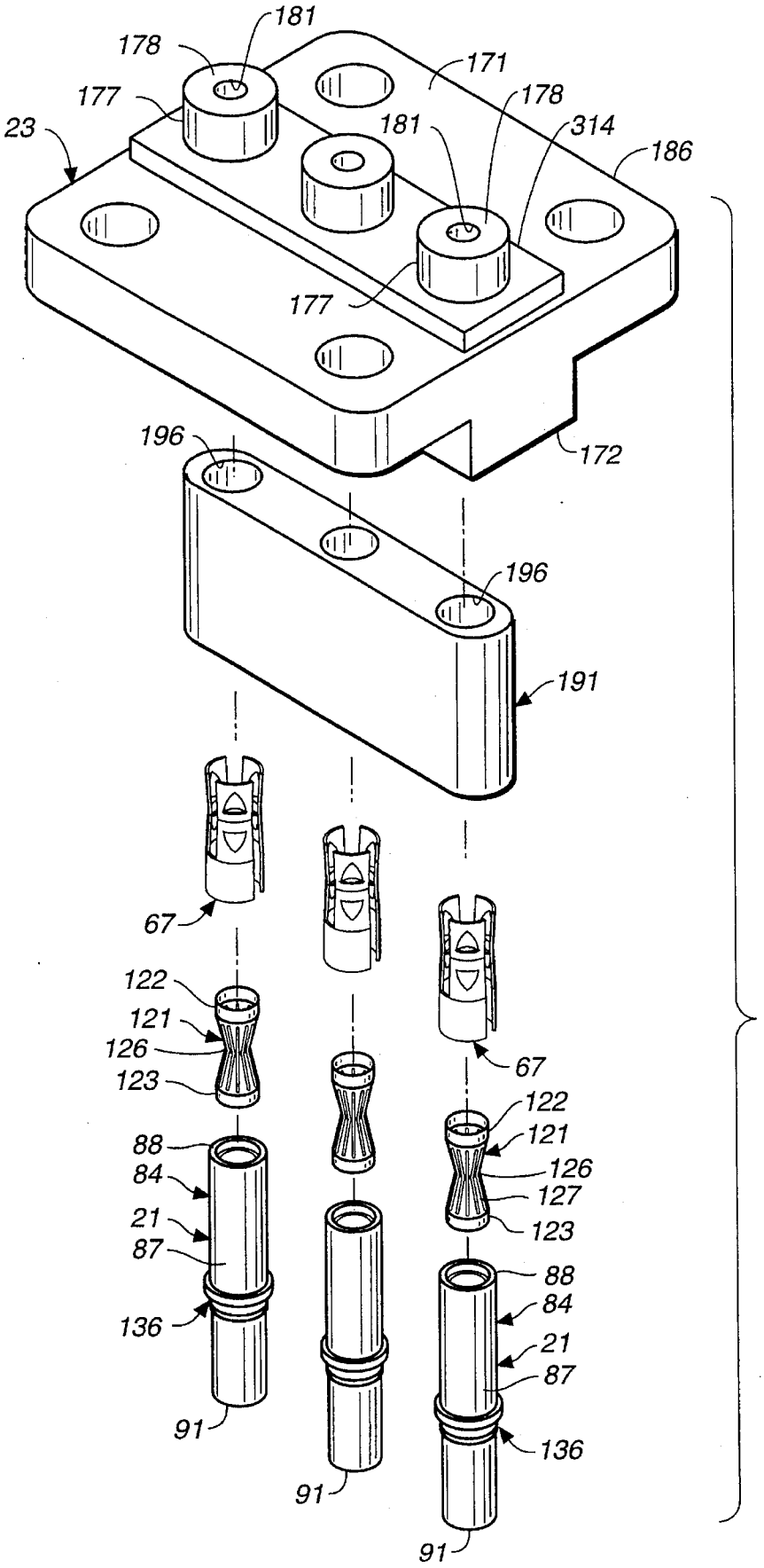
FIG. 4 is an exploded isometric view of a female connector housing with its attendant socket contacts in accordance with one embodiment of the present invention.

In general, a retention clip (also, retaining element, retention insert, or retaining clip) 67 of the present invention (FIGS. 1–2B) is for use with an electrical connector having a housing formed from a suitable plastic such as polyester. Before the retention clip of the present invention is described in detail, the connector housing, pin contact and socket contact used in conjunction with the retention clip will be described. A suitable connector is comprised of female and male mating housing portions or sections (i.e., connector housings) and 26 which connect together (FIGS. 3 and 4). Socket contact 21 is carried by female housing section 23. A pin contact 27, designed to cooperatively mate with socket contact 21, is carried by male housing section 26. The connector housing shown in the drawings is for use with three socket and pin contacts 21 and 27, but for simplicity only one socket contact and pin contact are illustrated in detail in the drawings and discussed herein. It should be appreciated that connectors having other configurations and carrying various numbers of socket and pin contacts 21 and 27 are within the scope of the present invention.

Figure 6A:
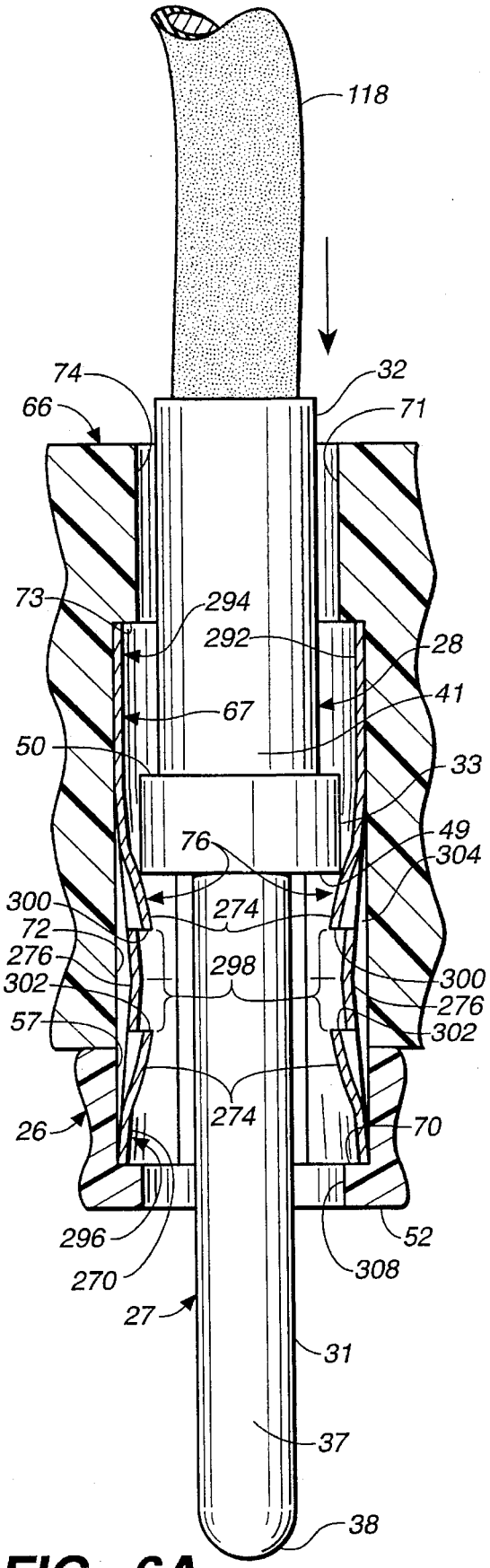
FIG. 6A is a partial cross-sectional view of a pin contact just prior to being retained by a retention clip in accordance with one embodiment of the present invention.
Figure 6B:
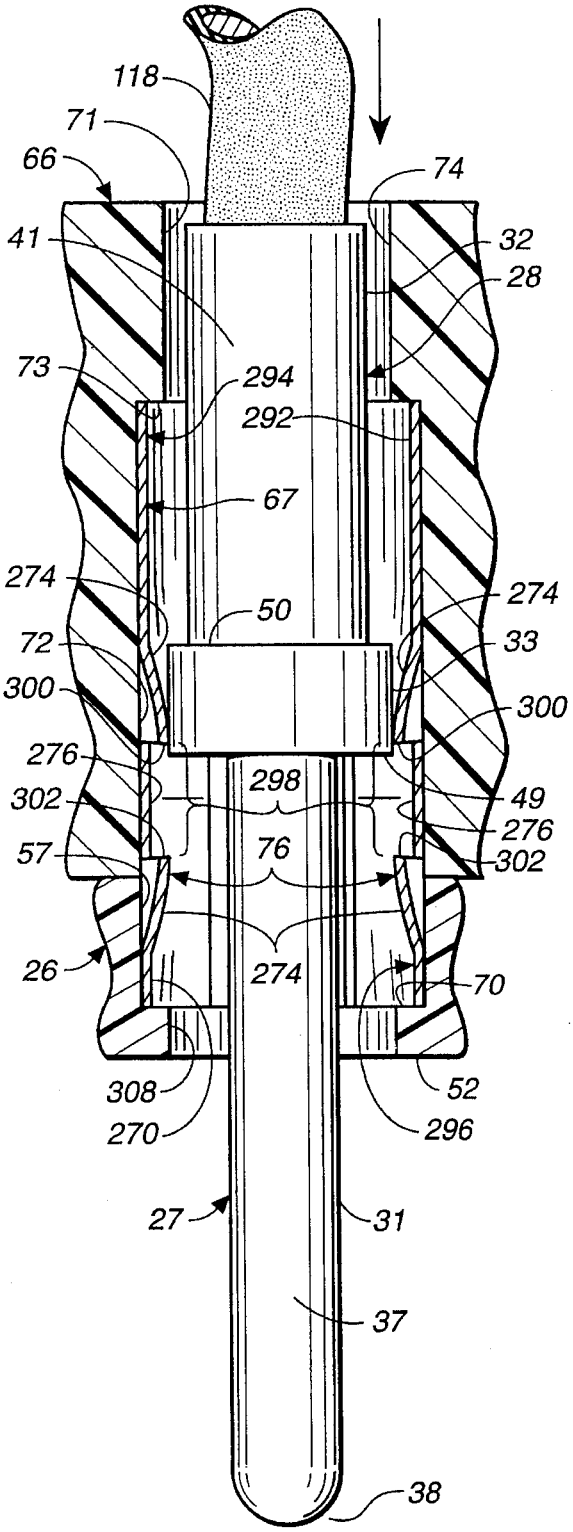
FIG. 6B is a partial cross-sectional view of the pin contact of FIG. 6A partially inserted into the retention clip retaining means.

A typical pin contact 27 consists of a conductive body 28 made of a suitable conductive material such as copper or brass and having a cylindrical shape (FIG. 3 and 6A). Conductive body 28 has an elongate slender contact pin 31 for mating with socket contact 21, an opposite and axially aligned second or shank portion 32 for relaying the electrical signal to a wire 118 or other electrical conductor, and a central portion or collar 33. Pin 31, serving as the distal end portion of pin contact 27, is generally cylindrical. Pin 31 has an outer surface 37 and a rounded end 38 which serves as the first end of pin contact 27. Shank portion 32 has an outer surface 41 of greater diameter than pin outer surface 37, an axially centered inner surface 42 (FIG. 3) which forms a bore for receiving conductive wire 118. Outer surfaces 37 and 41 are separated by collar 33 which forms an axially aligned annular stop ring. The ring projects radially outwardly from pin contact 27 beyond outer surface 41. Collar 33 has a forward seating surface or shoulder 49 and a rear seating surface or shoulder 50 which are generally perpendicular to the pin outer surface 37.

Male connector housing section 26 has first and second sides 51 and 52 and is provided with an oblong-shaped cavity 53 (FIG. 3) opening onto first side 51. Oblong-shaped cavity 53 includes three circular-shaped bores 57 (FIG. 6A) extending through the oblong-shaped cavity to second side 52. When pin contact 27 is mounted in male housing section 26, shank portion 32 of each pin contact 27 is partially housed in cavity 53 so that the related pin 31 extends through bore 57. Second side 52 can include a tubular shaped shield (not shown) for each bore 57 and pin 31 extending therethrough for limiting contact by personnel or equipment with pin 31 and pin contact 27. Each shield is typically axially aligned with the related bore 57 and pin 31. Male housing section 26 can also be provided with flanges 61 for securing to female housing section 23.

Figure 5A:
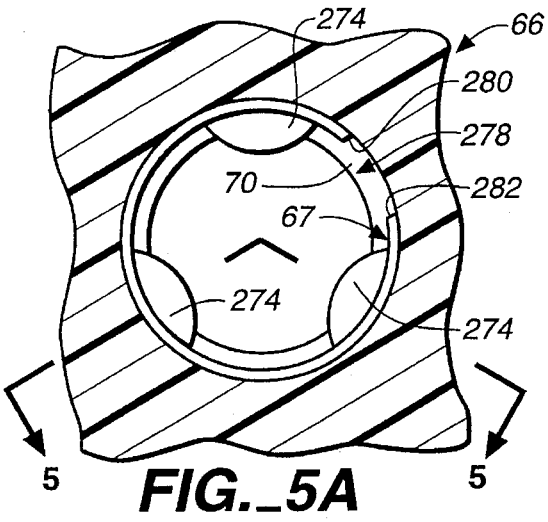
FIG. 5A is a cross-sectional view taken along line 5A—5A in FIG. 5.
Figure 5:
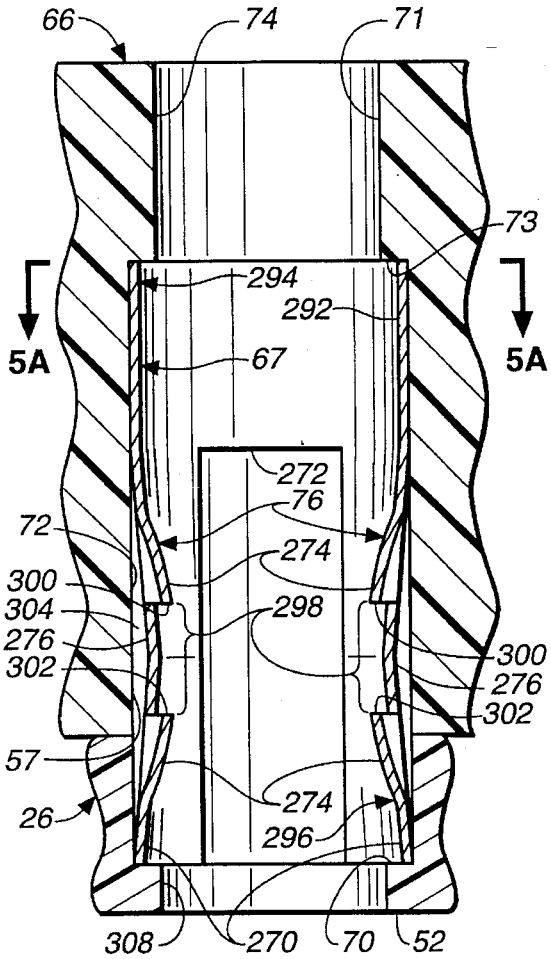
FIG. 5 is a cross-sectional view of a retention clip in a connector housing in accordance with one embodiment of the present invention taken along line 5—5 in FIG. 5A.

Pin contact 27 can be retained in male housing section 26 by an elongate locking element 66 and clip ring 67 (FIGS. 3 and 5). Locking element 66 is made from a suitable plastic such as polyester and is configured with an oblong-shaped cross-section and dimensioned so that a portion snaps into and seats within cavity 53. Locking element 66 has a leading end 68 and is provided with three bores 71 extending therethrough and designed to accommodate shank portion 32 therein. Each bore 71 is formed by an inner surface 72 and inner surface 74 of smaller diameter than surface 72 which results in an annular shoulder 73 for supporting retention clip 67.

Male housing section 26 is assembled by mounting retention element 67 in bore 71 and inserting pin contact 27 therethrough until the ends of retaining means 76 are positioned against leading shoulder 49 and trailing shoulder 50 of collar 47. Locking element 66, with pin contact 27 and retention element 67 mounted therein, is then snapped into cavity 53 of male housing section 26 with pin 31 protruding through bore 57.

Socket contact 21 (FIGS. 4 and 8A–8D) includes a receptacle section or hood 84 adapted to receive pin 31. Receptacle section or hood 84 is generally tubular in shape, with a central bore 85 extending therethrough, and is axially centered on a longitudinal axis. Hood 84 is made of a suitable conductive material such as copper or brass and has an outer surface 87 and first and second opposite and generally parallel ends 88 and 91. Hood 84 includes a first annular end portion or contact portion 93. Annular lip 212 and circular opening 111 result from rolling or pressing over the distal most end of portion 93. Lip 212 acts as a seating surface for conductive element 121.

A thin conductive element in the form of conductive strip or "crown" band 121 made from a beryllium-copper alloy or any other suitable material is mounted substantially around the inner surfaces of bore 85 in hood 84. "Crown" band 121 is generally tubular in shape and has a first end portion or engagement portion 122 (FIG. 4) and an opposite second end portion or engagement portion 123. Engagement portions 122 and 123 serve as mounting means for mounting "crown" band 121 within bore 85 in hood 84 and are each generally dimensioned to spring fit therein. "Crown" band 121 has a central contact portion 126 between and raised above engagement portions 122 and 123 for contacting pin 31. "Crown" contact portion 126 is formed from a plurality of spaced apart cross members 127 which are longitudinally aligned for contacting pin 31. Each cross member 127 is joined at opposite ends to engagement portions 122 and 123 and, when viewed in longitudinal cross-section, has an arcuate shape which extends radially inwardly toward the center thereof.

Socket contact 21 further includes a generally cylindrical middle section 136 (FIGS. 8A–8D) which is integrally formed with hood 84. Middle section 136 has a first end portion 137, a second opposite end portion or shank portion 138 and a central portion with annular stop ring or collar 141 therebetween. Collar 14 1 is formed from first or seating and second or trailing spaced apart generally parallel surfaces 143 and 142, respectively, which extend radially outward toward an outer surface 146 which interconnects surfaces 142 and 143 and is generally circular (FIGS. 8A–8D). End portion 158 is generally tubular in shape and has a bore which extends through end 158. The bore receives wire 118 or the like and can be a solder tail, crimp or printed circuit board tail.

First connector housing section 23 (FIG. 4) is similar in many respects to second connector housing section 26 and has first and second sides 171 and 172. Second side 172 is provided with an oblong-shaped cavity (not shown). Unlike second housing section 26, however, first side 171 of the first connector housing section 23 includes a receptacle, in the form of hollow tubular shaped casing 177, for housing each socket contact 21 used therewith (FIG. 4). More specifically, each casing 177 includes a relatively planar outer end surface 178 which serves as a mating surface and is provided with a bore 181 which opens at one end on casing end surface 178 and extends into first housing connector section 23. Bore 181 is formed by a generally circular-shaped inner surface 182. First housing connector section 23 can also have a plurality of flanges 186 for securing it to second housing connector section 26. However, flange 186 does not have to be present.

Socket contact 21 is retained in first connector housing section 23 by an elongate locking element 191 and retention element 67 substantially identical to locking element 66 and retention element 67 except, in some cases, locking element 191 is deeper than locking element 66 in order to accommodate hood 84 of socket contact 21. Locking element 191 is configured with an oblong-shaped cross-section and is dimensioned so that a portion snaps within the oblong cavity previously described but not shown. Locking element 191 is provided with bores 196 therethrough. Each bore 196 is designed to accommodate end portion 158 and is formed by a generally circular-shaped inner surface 192 having an annular shoulder 198. Retention element 67 has a retaining means 76 thereon (to be described in more detail below) which protrude radially inwardly and is supported in locking element 191 by annular shoulder 198 and annular shoulder 193.

Female housing section 23 is assembled by mounting retention element 67 in bore 196 and inserting socket contact 21 therethrough until the ends of retaining means 76 are positioned against leading surface 143 and trailing surface 142 of collar 141, similar to the insert of pin contact 27 as discussed above. Locking element 191, with socket contact 21 and retention element 67 mounted therein, is then snapped into the oblong cavity of female housing section 23 with hood 84 extending into bore 181 of casing 177.

Housing sections 23 and 26 can be slidably interconnected with each pin 31 protruding from male housing section second side 52 slidably received by a hood 84 of the corresponding socket contact 21 housed in casing 177 within female housing section 23.

When pin contact 27 is fully engaged with socket contact 21, pin 31 being disposed in hood 84, raised cross members or contacts 127 forming part of crown band 121 engage pin outer surface 41. Cross members 127 and outer surface 41 serve as the main electrical connection between socket and pin contacts 21 and 27.

Now, the unique and novel configuration of the retaining clip or retention element 67 will be described with respect to FIGS. 1–2B. For purposes of this description, principally two embodiments of the retention clip will be discussed, however as one of ordinary skill in the art will appreciate there are many embodiments for the retention clip that fail within the spirit and scope of the present invention and the claims appended hereto.

Figure 1:
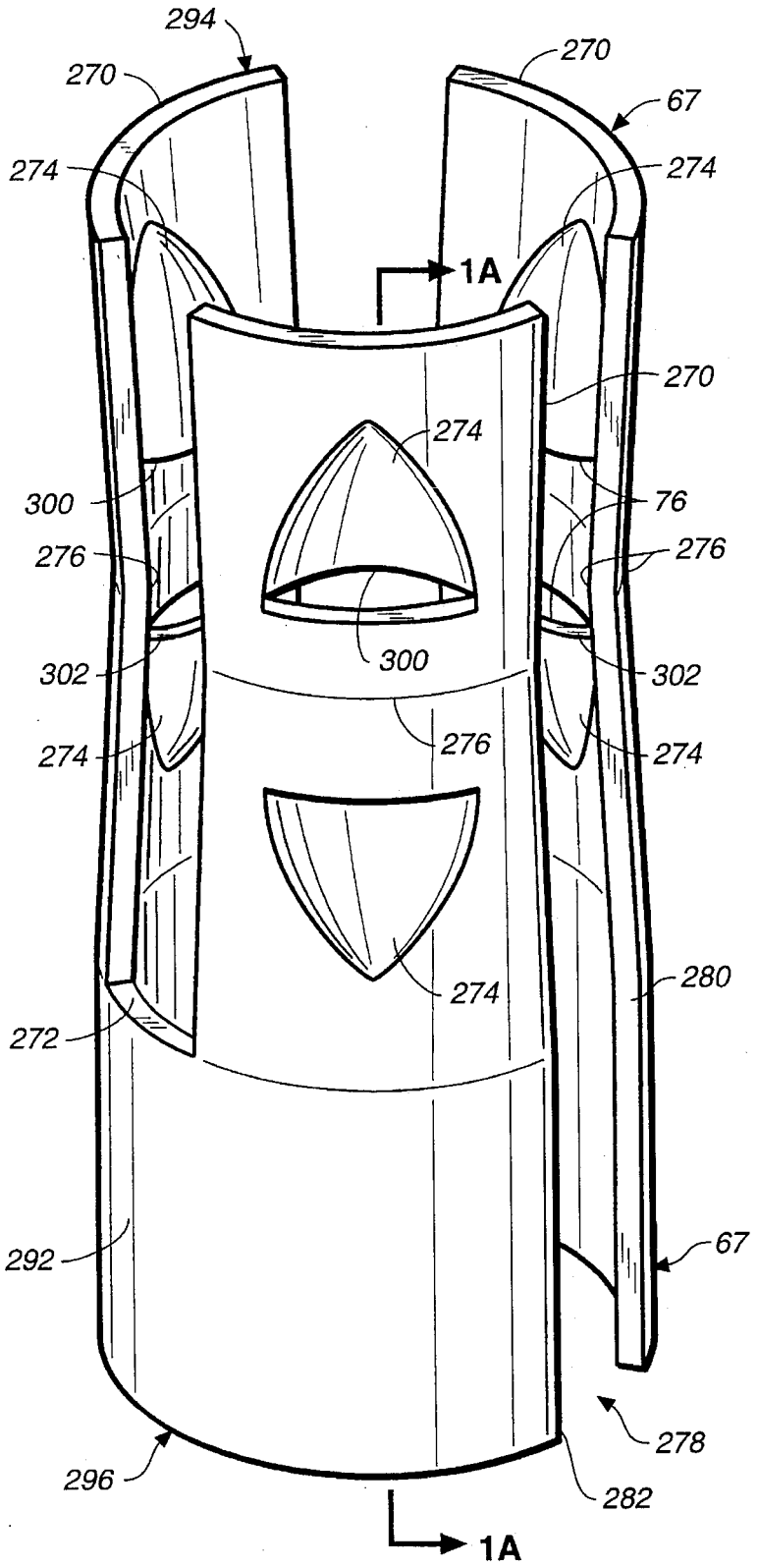
FIG. 1 is an isometric view of a retention clip in accordance with one embodiment of the present invention.
Figure 1A:
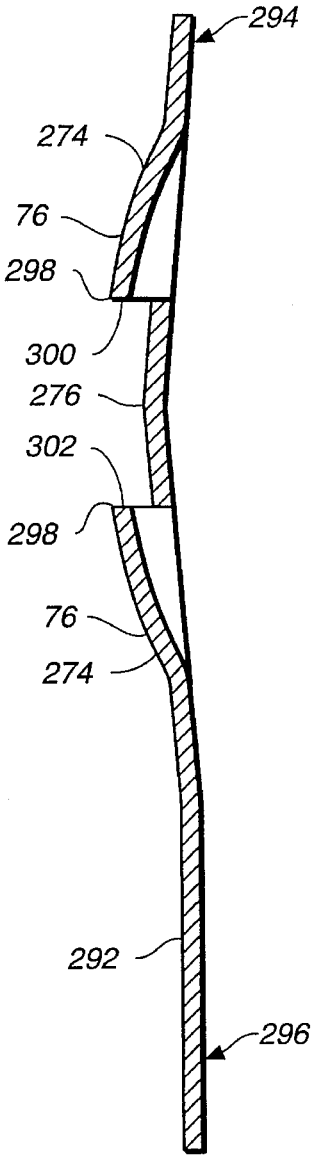
FIG. 1A is a cross-sectional view of the retention clip taken along line 1A—1A in FIG. 1.
Figure 2A:
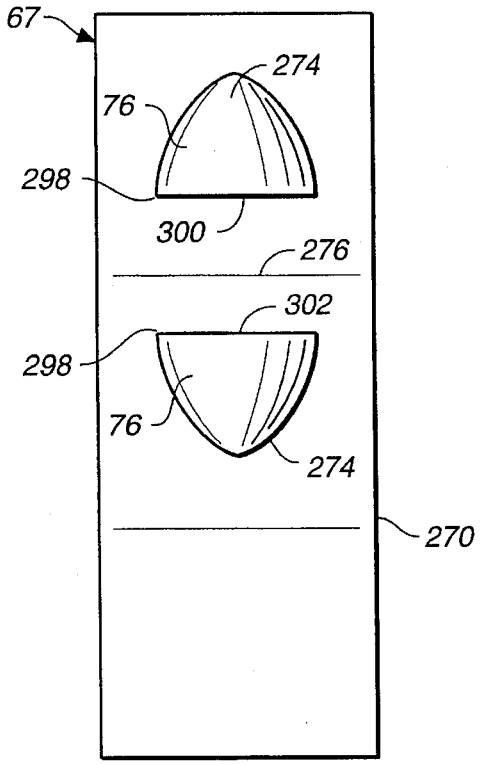
FIG. 2A is an elevational view of a retention clip in accordance with another embodiment of the present invention.
Figure 2:
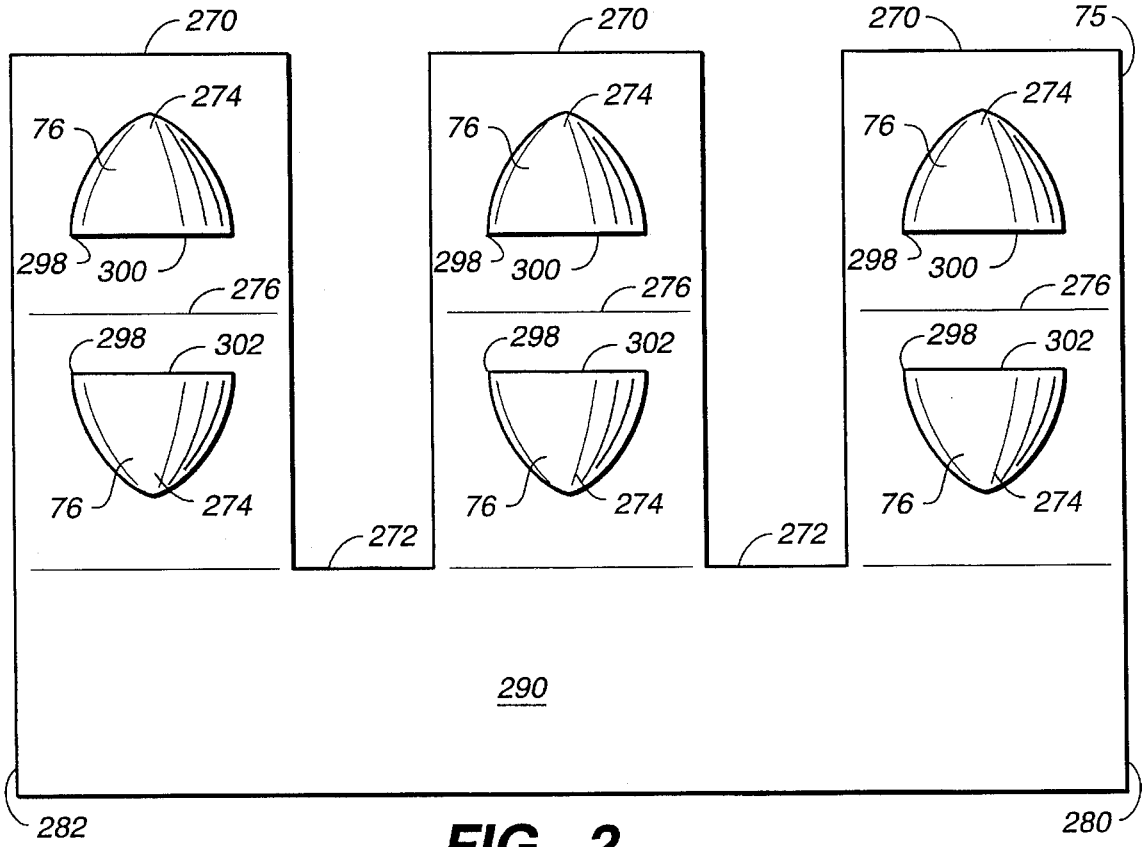
FIG. 2 is an elevational view of the retention clip prior to being formed into the generally cylindrical shape shown in FIG. 1.

FIGS. 1, 1A and 2 show one embodiment of the retention dement or retaining clip 67. Each retaining clip 67 is formed from a blank pattern or strip 75 (FIG. 2). Strip 75 can be formed in a normal stamping process by cutting out slots 252 from sheet metal or created in an extrusion process. The extrusion process is preferred because it does not create sharp cut edges. The extrusion process results in the formation of tines 270 (three in FIGS. 1 and 2, but there can be any number of tines from one on up depending on the size of the pin contact or socket contact to be retained within the retaining clip). Each tine 270 is a contact finger and has a retaining means 76 (i.e., locking mechanism) protruding therefrom. Retaining means 76 can be formed by pressing indentations or projections 274 into each tine 270. Between each projection on each tine 270, a bend or crease 276 is formed to give an arcuate shape to each tine (FIG. 1A). Bend 276 in each tine creates a cantilevered buckle beam that buckles after sufficient force is exerted against projections 274, as described below. Therefore, each tine is essentially a spring element. Strip 75 is then rolled into a generally cylindrical configuration as shown in FIG. 1, usually with a gap 278 between ends or edges 280 and 282 so that the retaining clip 67 can be compressed radially for insertion in the connector housing and then resiliently expand back out to spring fit within the cavity in the connector housing. The bottom portion 290 of strip 75 forms a partial ring base 292 with gap 278 therein, when the strip is rolled into its generally cylindrical configuration. Bend 276 in each tine 270 creates an hour-glass shape in the cylinder formed by rolling the strip. In the rolled configuration, retaining clip 67 has first end 294 and second end 296.

Retaining means 76 is formed by projections or tabs 274 which extend radially inward in the retaining clip from the tine or arcuate element 270. Tabs 274 are spaced from each other with gap 298 therebetween. The edges 300 and 302 of the projections on either side of gap 298 engage surfaces 49 and 50 of a pin contact or 143 and 142 of a socket contact as will be described below in more detail.

The embodiment of retaining element 67 as shown in FIGS. 2A and 2B is essentially a single tine 270 as discussed with respect to FIGS. 1 and 2. Essentially, tine or arcuate element 270 can be separated from a ring base 292 and placed in a cavity of a connector housing by itself, or any number of disconnected arcuate elements 270 can be placed in the connector housing and perform the same as the generally cylindrical embodiment of FIG. 1. Arcuate element 270 of FIGS. 2A and 2B have the same projections and bend as tines 270 of FIG. 1.

Figure 6C:
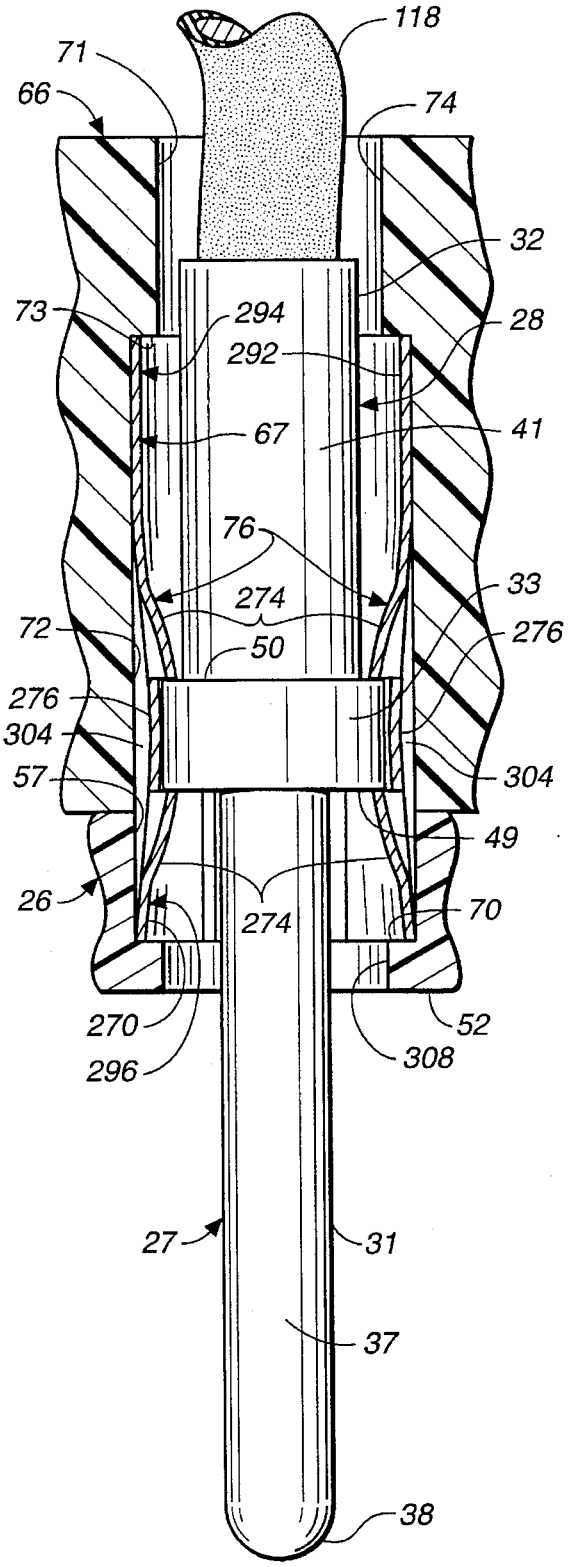
FIG. 6C is a partial cross-sectional view of the pin contact of FIG. 6B retained by the retention clip.

Now the operation of retaining element 67 will be described with respect to FIGS. 5–9C. Retaining clip 67 is placed in the connector housing between annular seating surface 73 and annular seating surface 70 (FIG. 5). Gap 278 allows retaining clip 67 to be spring fit within bore 57 and inner surface 72. The arcuate shape of tines 270 created by bend 276 results in an annular space 304 between the central portion of each arcuate element and inner surface 72. Pin contact 27 is loaded into the connector housing by inserting the contact through the opening into bore 71 in the rear of the connector housing. As pin contact 27 is pushed into the connector housing, the leading edges of collar 33 on first seating surface 49 contact projections or tabs 274 on each tine 270 (FIG. 6A). As pin contact 27 is inserted further, it exerts force against the bias created by bend 276. The tabs or projections 274 are relatively rigid, principally because of their semi-dome shape, such that they do not collapse when the pin contact exerts force against them. Instead, the tabs transfer the force to the relatively flexible portion of the tine in the area of bend 276. As a result of tabs 274 being spaced from each other with flexible bend 276 between them on each tine 270 and collar 33 forcing arcuate element 270 outward against surface 72 as shown in FIG. 6A such that annular space 304 no longer exists, edge 300 and 302 of retaining means 76 move radially outward and allow collar 33 to pass by the first set of tabs and into gap 298 between edges 300 and 302. After collar 33 has passed into gap 298, the resiliency of bend 276 biases the arcuate tine back toward the center of the retaining clip resulting in edge 302 of each tine contacting first surface 49 and edge 300 contacting second surface 50 of collar 33 so that pin contact 27 is retained in retaining means 76 (FIG. 6C).

Figure 7A:
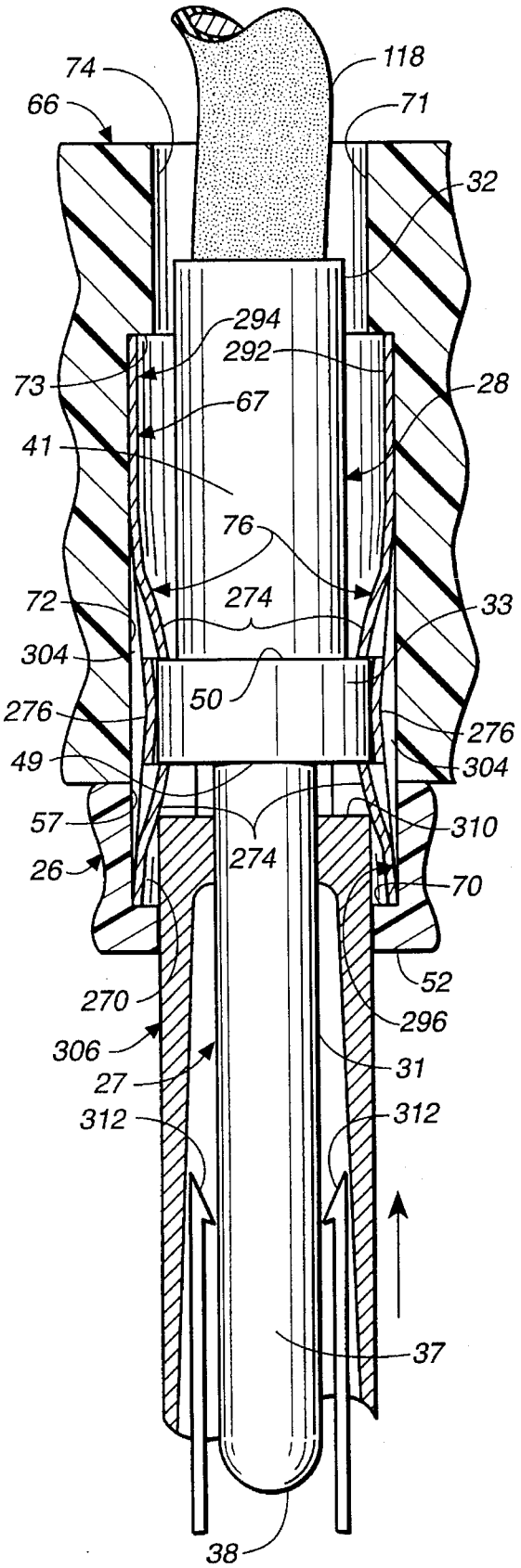
FIG. 7A is a partial cross-sectional view of a front release/front extraction tool partially inserted into the front of a connector housing in accordance with one embodiment of the present invention.
Figure 7B:
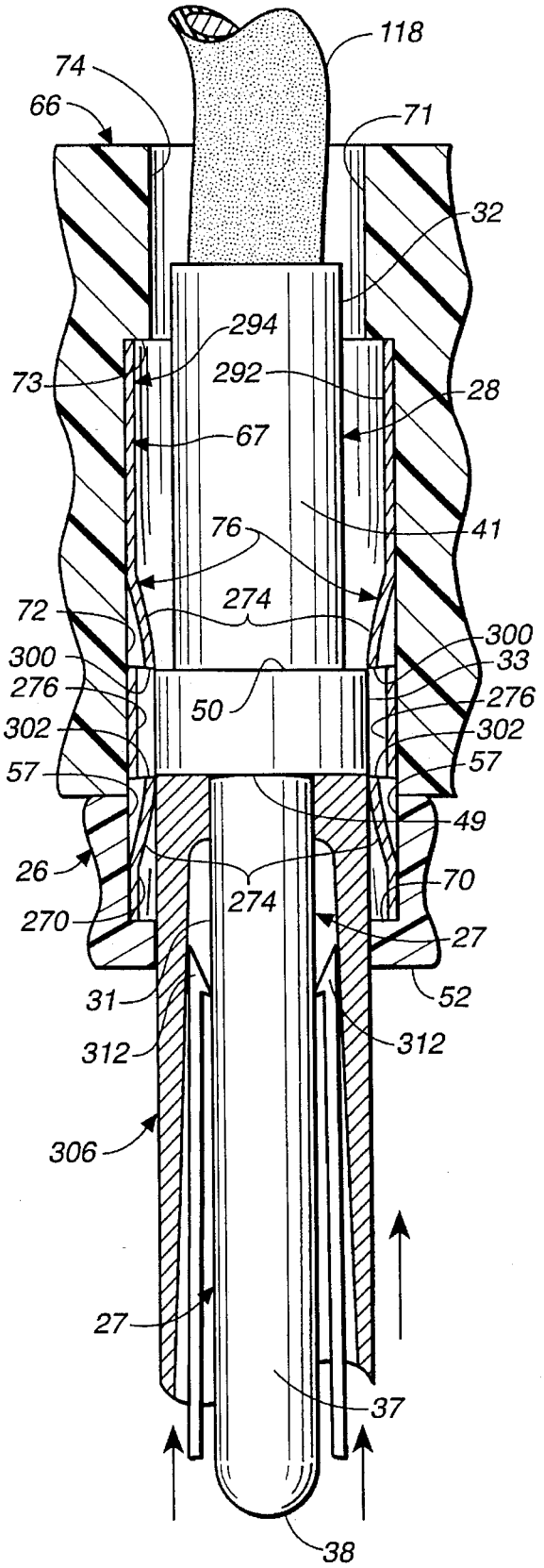
FIG. 7B is a partial cross-sectional view of the front release/front extraction tool of FIG. 7A fully inserted into the front of the connector housing to release the pin contact from the retention clip.
Figure 7C:
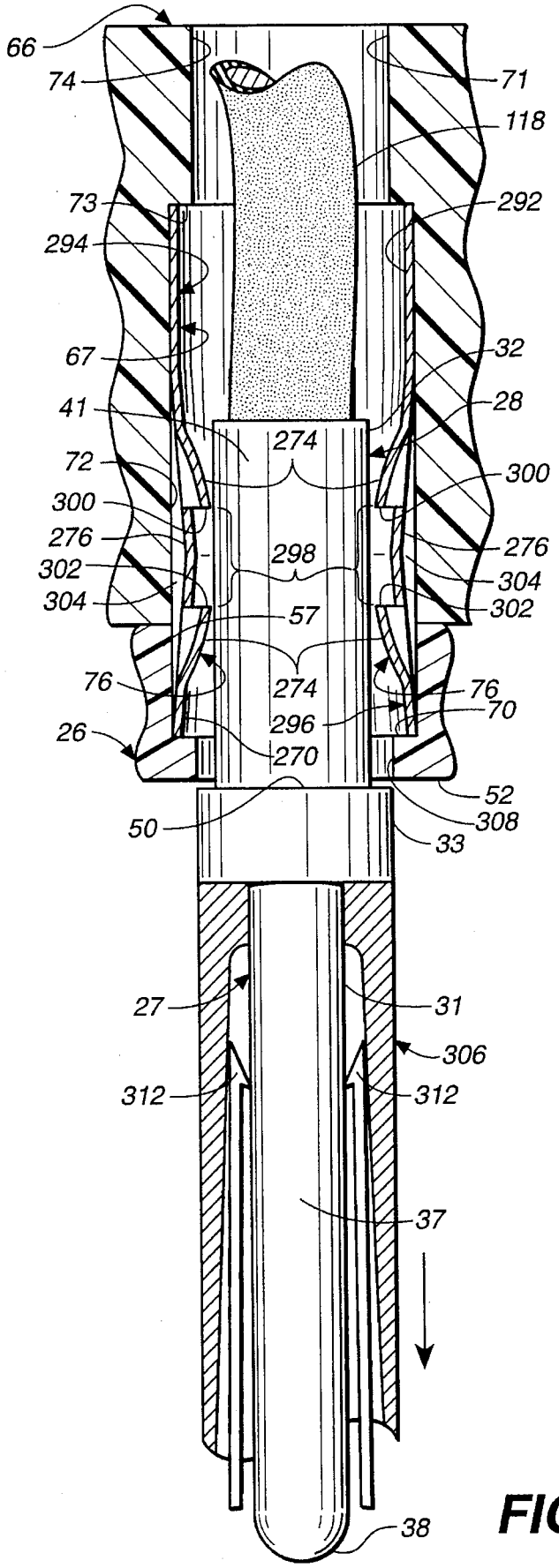
FIG. 7C is a partial cross-sectional view of the front release/front extraction tool and pin contact of FIG. 7B being withdrawn from the front of the connector housing.

The novel configuration of retaining clip 67 allows the retaining clip to be universally releasable and extractable as illustrated with respect to FIGS. 7A–7C, 8A–8D, and FIGS. 9A–9C. FIGS. 7A–7C illustrate how a front release/front (or rear) extraction tool can be used to remove pin contact 27 and wire 118 for repair or replacement. A pin contact front release/front (or rear) extraction tool 306 of a variety of configurations can used. The configuration shown in FIGS. 7A–7C is only for illustration purposes. The tool is inserted through opening 308 in housing 26 until it contacts projections 274. Then, in the same way that the leading edges of collar 33 on pin contact 27 deflected the arcuate element so that the projections move simultaneously, the leading edge 310 of tool 306 deflects arcuate tine 270 resulting in the simultaneous release of edges 300 and 302 as bend 276 of each tine is deflected back against inner surface 72 (FIG. 7B) as leading edge 310 of tool 306 comes in contact with leading surface 49 of collar 33.

The tine or arcuate element 270 is resiliently biased such that when the arcuate element is contacted near first end 294, retaining means 76 is disengaged from both leading surface 49 and trailing surface 50 simultaneously. [Likewise, when the arcuate element is contacted near second end 296 (as will be described in more detail below), retaining means 76 is disengaged from both the leading surface and trailing surface of the collar on the electrical contact.] At the point, when both the leading surface 49 and trailing surface 50 of collar 33 are released from retaining means 76 (FIG. 7B), pin contact 27 and wire 118 can be pushed through the opening in the rear of the connector housing or, as illustrated in FIG. 7C, pin 31 can be grasped by extraction member(s) 312 and removed from the front of the connector housing. Preferably, edges 302 and 300 of projection 274 have a certain amount of back taper so that they do not create sharp edges that may scrape and damage wire 118 as it is pulled through the retention clip and out the front of the connector housing. It is beneficial to provide a service loop (i.e., extra length of wire) within the equipment housing so that the pin and wire can be removed from the front of the housing connector far enough to be worked on easily. The immediate previous discussion illustrates that with the novel configuration of the retaining element of the present invention that a pin contact can be released from the front of a connector housing and extracted from either the front or the back of the connector housing.

Figure 8A:
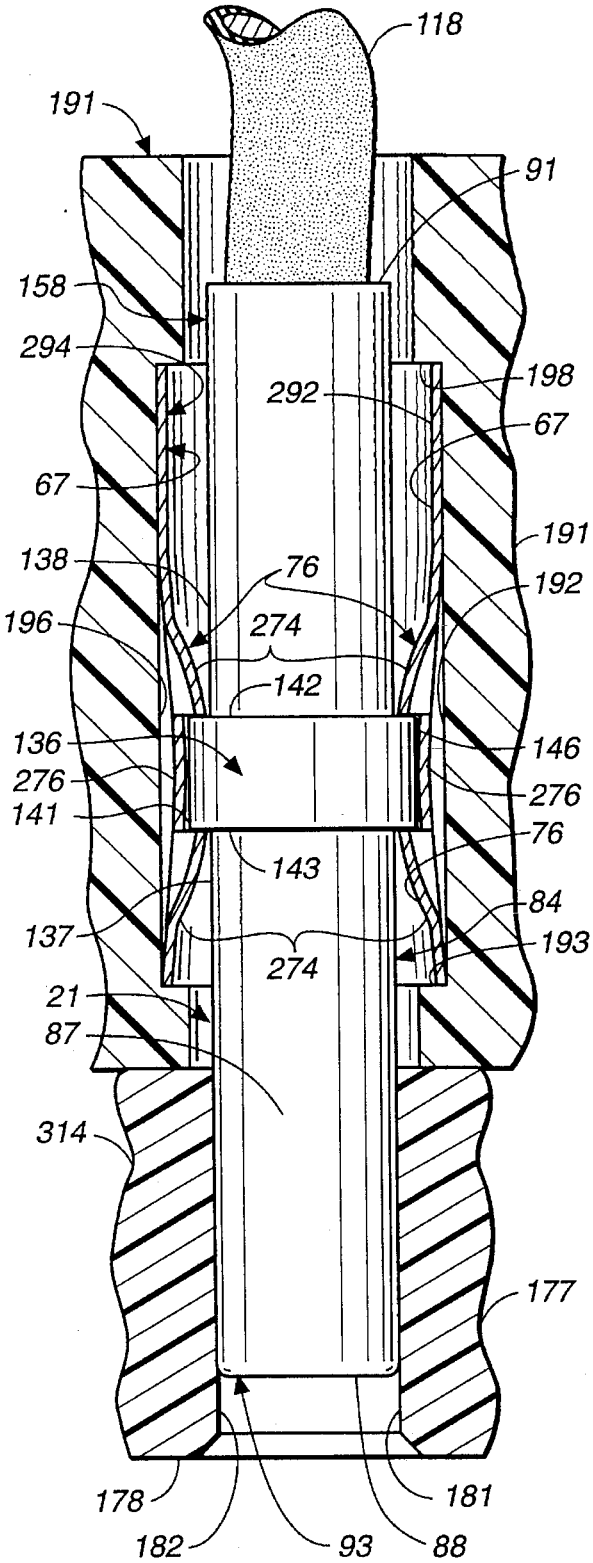
FIG. 8A is a partial cross-sectional view of a socket contact retained by the retention clip.
Figure 8B:
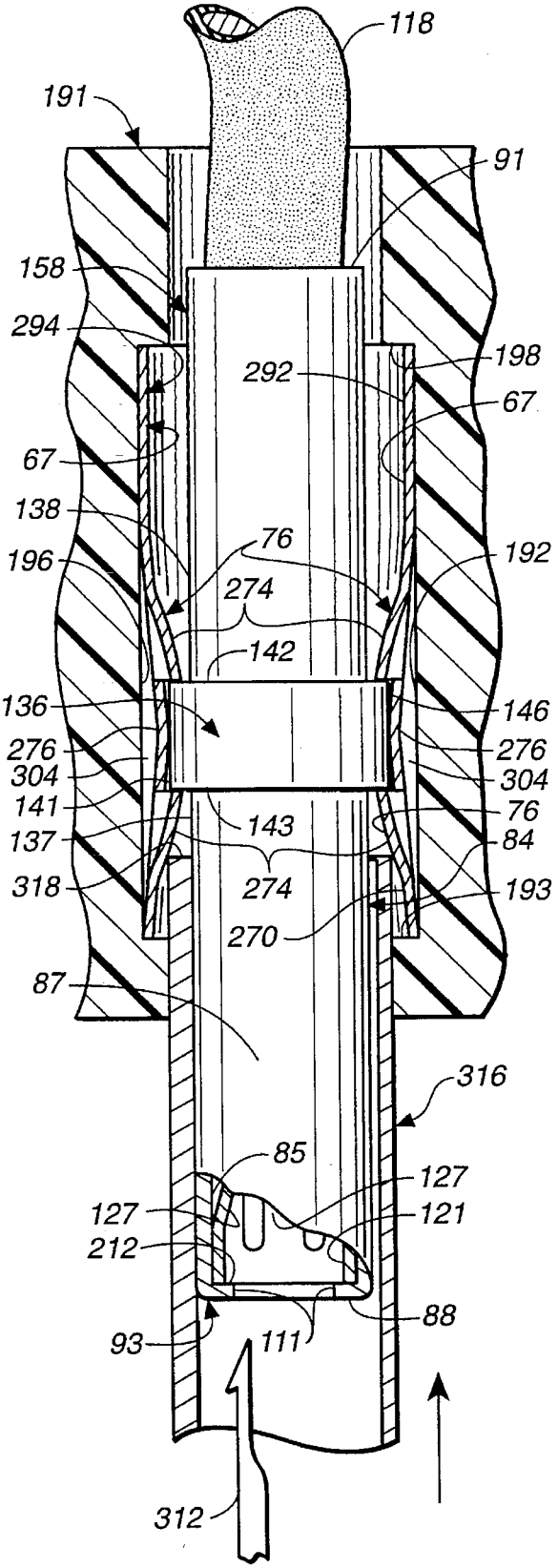
FIG. 8B is a partial cross-sectional view of a front release/front extraction tool of FIG. 8A partially inserted into the front of the connector housing in accordance with one embodiment of the present invention.
Figure 8C:
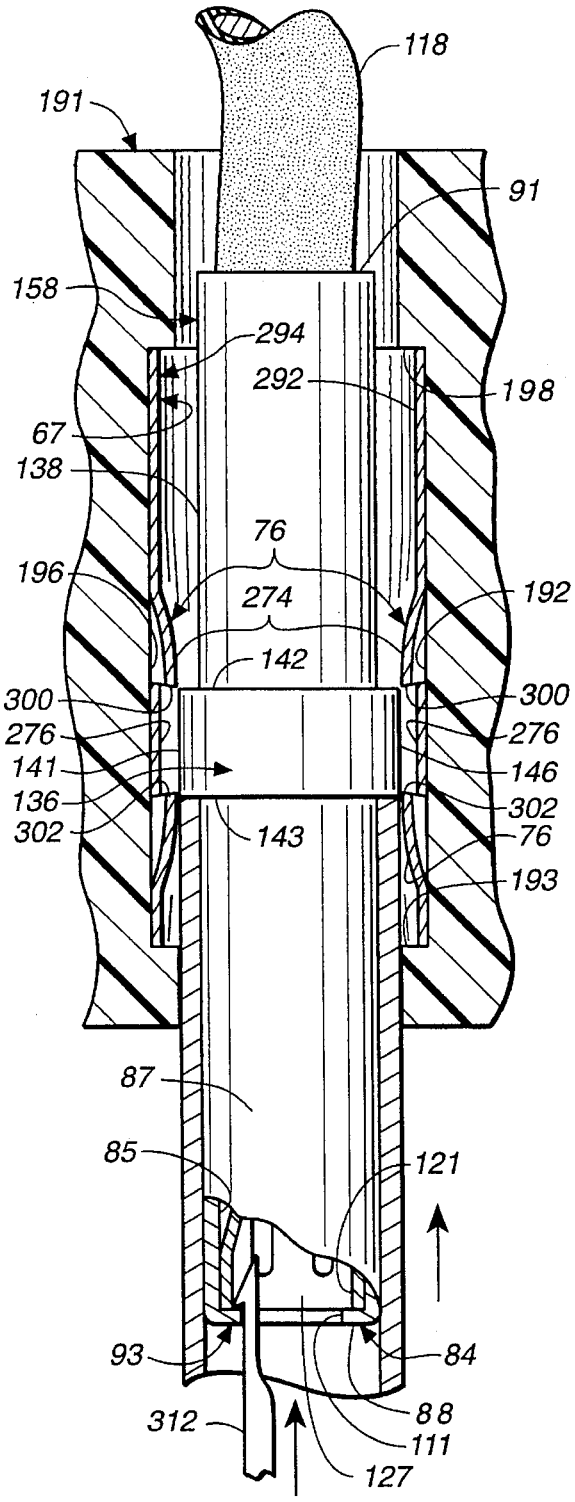
FIG. 8C is a partial cross-sectional view of the front release/front extraction tool, fully inserted into the front of the connector housing of FIG. 8B to release the socket contact from the retention clip.
Figure 8D:
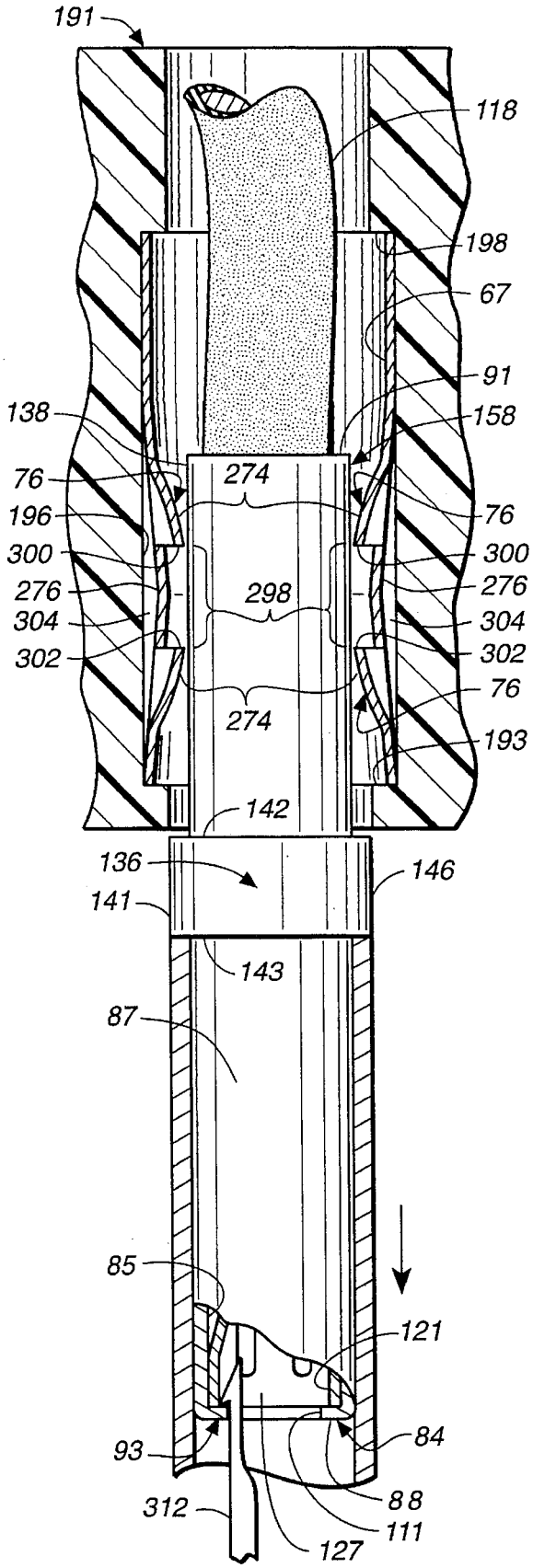
FIG. 8D is a partial cross-sectional view of the front release/front extraction tool and socket contact of FIG. 8C being withdrawn from the front of the connector housing.

In a similar manner, FIGS. 8A–8D illustrate that with the retaining element of the present invention that a socket contact can be released from the front and extracted from either the front or the back of a connector housing. For the socket contact, since typically hood 84 of socket contact 21 is fit snug within bore 181 of tubular casing 177, faceplate 314 is removed first. Then in similar fashion as previously described, socket contact front release/front (or rear) extraction tool 316 is inserted into the connector housing such that leading edge 318 contacts the first set of projections 274. A socket contact front release/front (or rear) extraction tool 316 of a variety of configurations can be used. As leading edge 318 comes into contact with seating surface 143, both edges 300 and 302 are simultaneously released from seating surfaces 143 and 142 as bend 276 is deflected against surface 196 thus eliminating annular gap 304 (FIG. 8C). At this point, both seating surfaces 143 and 142 of collar 136 are released from retaining means 76 and the socket contact and wire can be pushed through the opening in the rear of the connector housing or, as illustrated in FIG. 8D, socket contact portion 93 can be grasped by extraction member(s) 312 and removed from the front of the connector housing. The immediate previous discussion illustrates that with the novel configuration of the retaining element of the present invention that a socket contact can also be released from the front of a connector housing and extracted from either the front or the back of the connector housing.

Figure 9A:
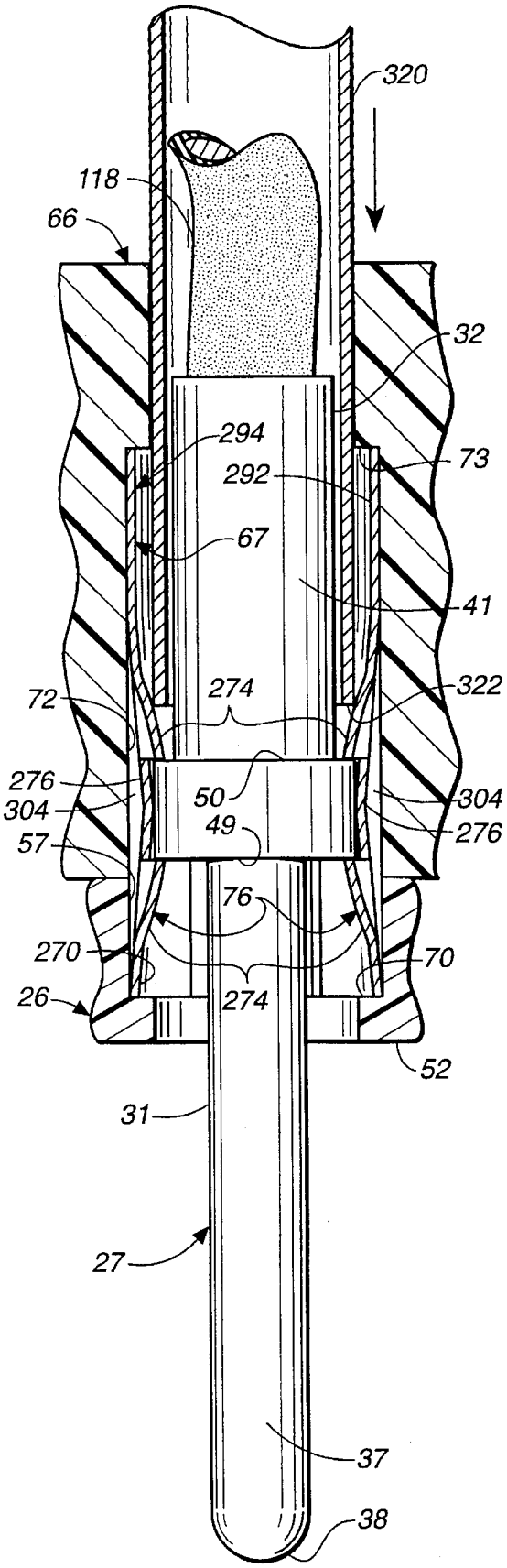
FIG. 9A is a partial cross-sectional view of a rear release tool partially inserted into the rear of a connector housing in accordance with one embodiment of the present invention.
Figure 9B:
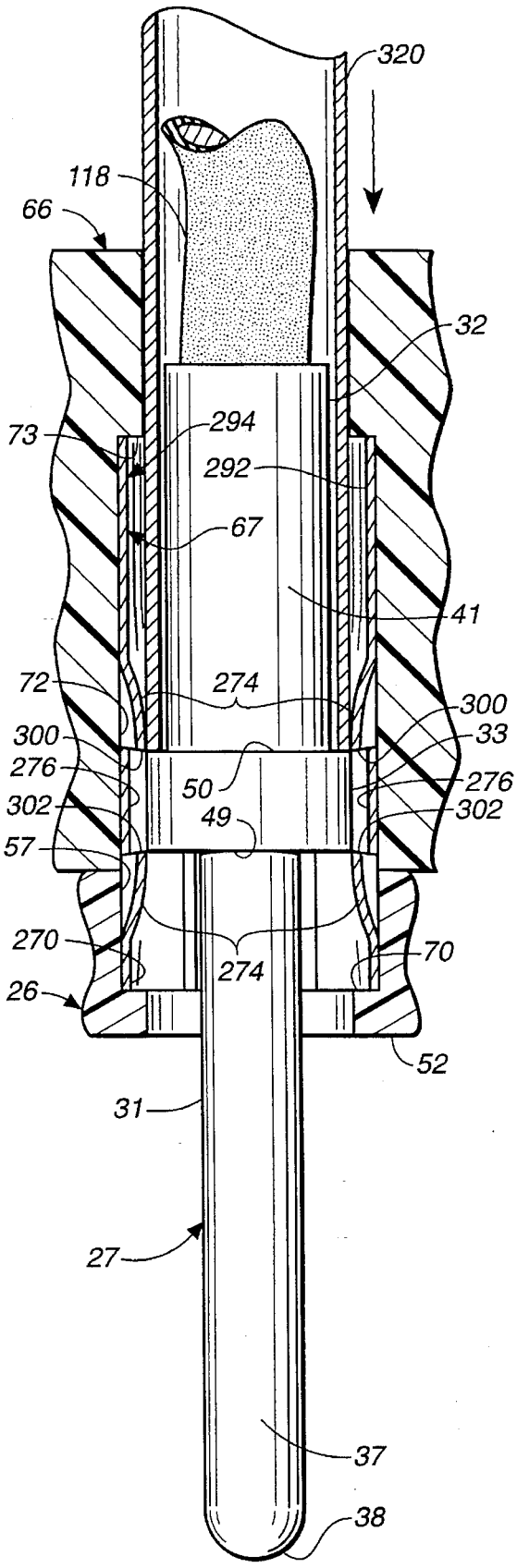
FIG. 9B is a partial cross-sectional view of the rear release tool fully inserted into the rear of the connector housing of FIG. 9A to release the socket contact from the retention clip.
Figure 9C:
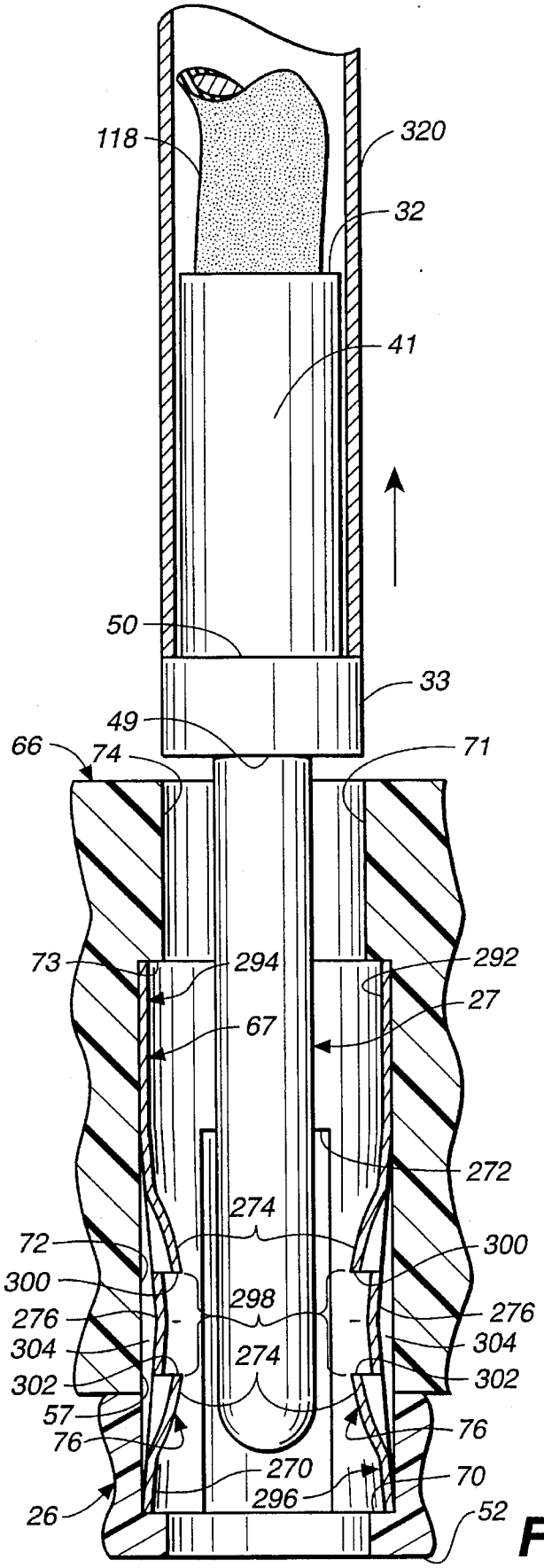
FIG. 9C is a partial cross-sectional view of the rear release tool and pin contact of FIG. 9B being withdrawn from the rear of the connector housing.
Figure 11:
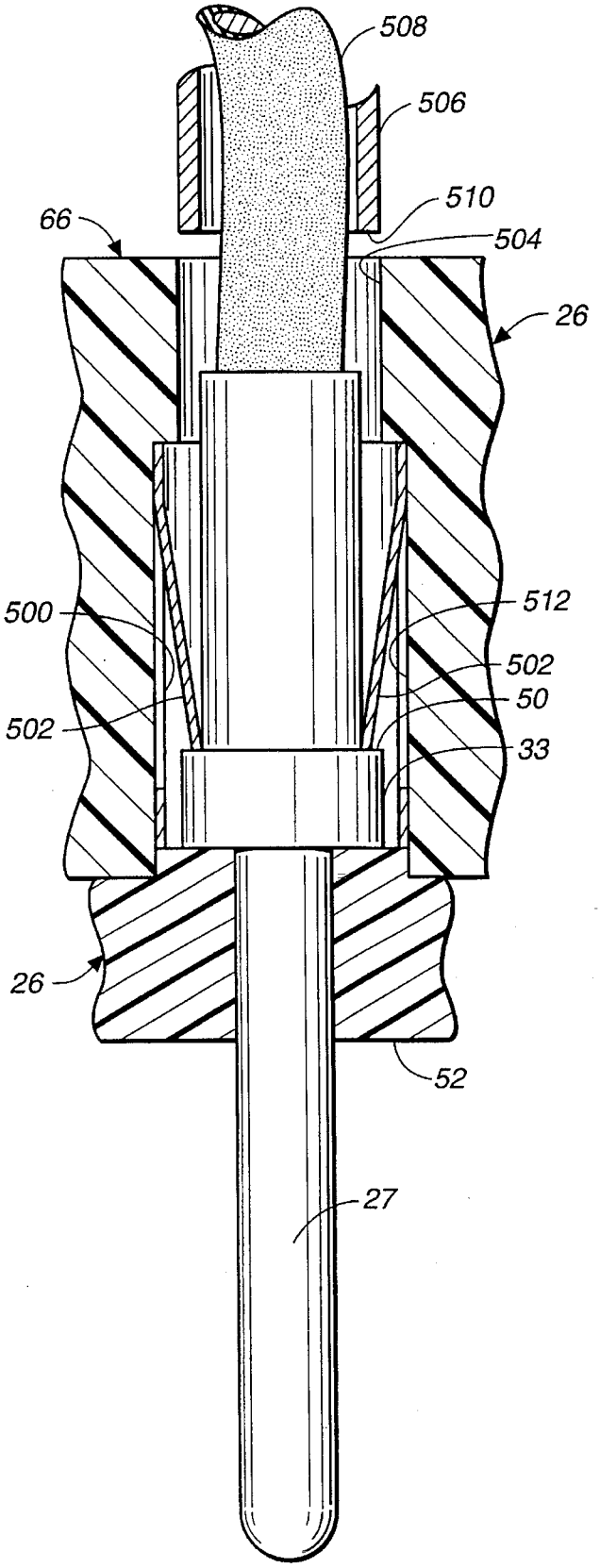
FIG. 11 (PRIOR ART)
FIG. 11 is a partial cross-sectional view of a pin contact in a rear release/rear extraction retention clip in accordance with the prior art.
Figure 10:
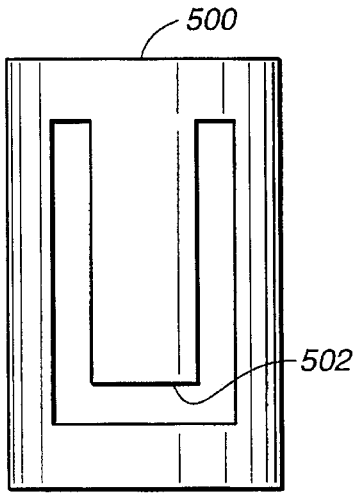
FIG. 10 (PRIOR ART)
FIG. 10 is an elevational view of a rear release/rear extraction retention clip in accordance with the prior art.

In a similar manner, FIGS. 9A–9C illustrate that with the retaining element of the present invention that a pin contact (or socket contact, not shown but operates in similar fashion) can also be released from the rear of a connector housing and extracted from either the front or the rear of the connector housing using a conventional release/extraction tool 320. The tool is inserted through the opening into bore 71 until it contacts projections 274. Then, in the same way that the leading edges of collar 33 on pin contact 27 deflected the arcuate element so that the projections move simultaneously away from the center of bore 71, the leading edge 322 of tool 320 deflects arcuate tine 270 resulting in the simultaneous release of edges 300 and 302 from surfaces 49 and 50 as bend 276 of each tine is deflected back against inner surface 72 (FIG. 9B) as leading edge 310 of tool 306 comes in contact with trailing surface 50 of collar 33. At this point, both the leading surface 49 and trailing surface 50 of collar 33 are released from retaining means 76 and the pin contact and wire can be pushed through the opening in the front of the connector housing or, as illustrated in FIG. 9C, removed from the rear of the connector housing. The immediate previous discussion illustrates that with the novel configuration of the retaining element of the present invention that a pin (or socket) contact can also be released from the rear of a connector housing and extracted from either the front or the back of the connector housing. The culmination of the discussions relating to FIGS. 7A–9C illustrate that with the novel configuration of retaining element 67 of the present invention a universally releasable/extractable retaining element is provided.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made other than those discussed by workers of ordinary skill in the art without departing from the scope of the present invention as defined by the following claims.

The invention claimed is:

1. A retaining clip for receiving a collar on an electrical contact, the collar having a first face and a second face, said clip comprising:

at least one arcuate element having a first end and a second end, and a retaining means located between the first end and the second end adapted to engage the first face and second face of the collar for removably retaining the electrical contact in the clip, said arcuate element being resiliently biased such that when the arcuate element is deflected the first end, the retaining means is consequently and substantially simultaneously disengaged from both the first face and the second face.

2. The clip of claim 1, wherein when the arcuate element is contacted near the second end, the retaining means is disengaged from both the first face and the second face.

3. The clip of claim 1, comprising:

at least two arcuate elements connected at their first ends respectively by a base.

4. The clip of claim 1 wherein the retaining means, comprises:

a first tab having a collar engaging end and extending from a first surface of the arcuate element; and a second tab having a collar engaging end spaced opposite from said first tab and extending from the first surface of the arcuate element;

said first tab and second tab are spaced from each other such that the collar engaging end of the first tab engages the first face of the collar and the collar engaging end of the second tab engages the second face of the collar to removably retain the electrical contact in the clip.

5. A connector comprising:

a housing having at least one receptacle;

at least one retaining element in the receptacle having a first end and a second end, and a retaining means located between the first end and the second end for receiving a collar on an electrical contact, said retaining means adapted to engage a first face and a second face of the collar for removably retaining the electrical contact in the housing, said retaining element is bowed away from a wall of the receptacle and is resiliently biased such that when the retaining element is deflected near its first end toward the wall of the receptacle the retaining means is consequently and substantially simultaneously disengaged from both the first face and the second face.

6. The connector of claim 5, wherein when the retaining element is deflected near its second end toward the wall of the receptacle the retaining means is disengaged from both the first face and the second face.

7. The connector of claim 5, comprising:

at least two retaining elements connected at their first ends respectively by a base.

8. The connector of claim 5 wherein the retaining means, comprises:

a first tab having a collar engaging end and extending from a first surface of the retaining element; and a second tab having a collar engaging end spaced opposite from said first tab and extending from the first surface of the retaining element;

said first tab and second tab are spaced from each other such that the collar engaging end of the first tab engages the first face of the collar and the collar engaging end of the second tab engages the second face of the collar to removably retain the electrical contact in the connector.

9. The connector of claim 5 wherein the electrical contact is a pin.

10. The connector of claim 5 wherein the electrical contact is a socket.

11. A connector comprising:

a housing having a plurality of passages; and at least one retention insert in each of the passages having a cantilevered spring element extending from a partial cylindrical base of the retention insert;

said cantilevered spring element having a first end, a second end and a retaining means located between the first end and the second end for receiving a collar on an electrical contact;

said retaining means adapted a first shoulder and a second shoulder of the collar for removably retaining the electrical contact in the housing;

said cantilevered spring element is resiliently biased away from a wail of the passage such that when the cantilevered spring element is deflected near its first end toward the wall of the passage, the retaining means is consequently and substantially simultaneously moved away from both the first shoulder and the second shoulder.

12. The connector of claim 11, wherein when the cantilevered spring element is deflected near its second end toward the wall of the passage, the retaining means is moved away from both the first shoulder and the second shoulder.

13. The connector of claim 11 wherein the retaining means, comprises:

a first extension having a collar engaging end and extending from a surface of the cantilevered spring element toward the center of the passage; and a second extension having a collar engaging end spaced opposite from said first extension and extending from the surface of the cantilevered spring element toward the center of the passage;

said first extension and second extension are spaced from each other such that the collar engaging end of the first extension engages the first shoulder of the collar and the collar engaging end of the second extension engages the second shoulder of the collar to removably retain the electrical contact in the connector.

14. The connector of claim 11 wherein the electrical contact is a pin.

15. The connector of claim 11 wherein the electrical contact is a socket.

* * * * *

UNITED STATES PATENT AND TRADEMARK OFFICE

CERTIFICATE OF CORRECTION

PATENT NO. : 5,575,691

DATED : November 19, 1996

INVENTOR(S) : Russell H. Matthews

It is certified that error appears in the above-indentified patent and that said Letters Patent is hereby corrected as shown below:

Claim 11, Col. 12, line 17, add --to engage-- after "adapted".

Signed and Sealed this

Twenty-seventh Day of May, 1997

*Attest:*

Bruce Lehman

BRUCE LEHMAN

*Attesting Officer*

*Commissioner of Patents and Trademarks*